US005875718A

United States Patent [19]

Schild et al.

[11] Patent Number: 5,875,718

[45] Date of Patent: Mar. 2, 1999

[54] ADJUSTING DEVICE FOR PRINTING PLATES

[75] Inventors: Helmut Schild, Steinbach; Michael Rother, Rodermark, both of Germany

[73] Assignee: MAN Roland Druckmaschinen, AG, Germany

[21] Appl. No.: 920,819

[22] Filed: Aug. 29, 1997

[30] Foreign Application Priority Data

Aug. 29, 1996 [DE] Germany ..... 196 34 947.8

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 4,813,356 | 3/1989 | Abendroth et al. | 101/415.1 |
| 5,181,469 | 1/1993 | Merkel et al. | 101/415.1 |
| 5,325,778 | 7/1994 | Hartung et al. | 101/415.1 |
| 5,339,738 | 8/1994 | Blaser et al. | 101/415.1 |
| 5,367,954 | 11/1994 | Becker | 101/415.1 |
| 5,542,657 | 8/1996 | Kemmerer et al. | 271/82 |
| 5,694,854 | 12/1997 | Becker | 101/415.1 |

FOREIGN PATENT DOCUMENTS

| | | |
|---|---|---|
| 35 32 003 C2 | 4/1989 | Germany . |
| 42 14 168 C2 | 10/1994 | Germany . |
| 43 21 751 C1 | 11/1994 | Germany . |

*Primary Examiner*—Ren Yan
*Assistant Examiner*—Daniel J. Colilla
*Attorney, Agent, or Firm*—Leydig, Voit & Mayer, LTD.

[57] ABSTRACT

An device for adjusting the tension applied on a printing plate on a plate cylinder of a sheet fed offset printing machine is provided. The device includes a clamping bar comprising at least one clamping bar section and having a clamping gap which receives an end of the printing plate. Moreover, the clamping bar is arranged so that it can move approximately in the circumferential direction of the plate cylinder. The device further includes a spring element which acts on the clamping bar so as to apply a tensile force on the printing plate. The device also includes an adjusting element pivotally supported on the cylinder such that it can be pivoted counter to the force of a spring from a disengaged position into engagement with the clamping bar in order to selectively reduce the tensile forces exerted on the printing plate by the spring element.

6 Claims, 5 Drawing Sheets

ADJUSTING DEVICE FOR PRINTING PLATES

FIELD OF INVENTION

The present invention relates to printing machines, and more particularly to an adjusting device for printing plates on the plate cylinder of a printing machine.

BACKGROUND OF THE INVENTION

In sheet-fed offset printing machines, a printing plate is attached to a plate cylinder of the print units by first clamping the leading edge of the printing plates in a corresponding attachment device on the plate cylinder. Next the printing plate is mounted around the outside circumference of the plate cylinder. The trailing edge of the printing plate is then introduced into a corresponding tensioning device, whereupon the printing plate is tensioned around the outside circumference of the plate cylinder via the trailing edge of the printing plate. Presently, a large number of automated devices are known for the clamping and tensioning of printing plates onto a plate cylinder which enable these steps to be carried out simply by actuating corresponding operating elements. For example, an operator only has to introduce the leading edge of the printing plate into the corresponding clamping bar and then actuate a corresponding operating element which triggers the clamping. Similarly, introducing the trailing edge of the printing plate into the corresponding tensioning device of the plate cylinder can also be carried out in an automated manner such that the attachment of the printing plate to the plate cylinder is totally automatic.

A device for mounting printing plates on the plate cylinder of sheet-fed offset printing machines is known from DE 4,214,168 C2, in which the leading edge of the printing plate is first attached to the plate cylinder by an attachment device and the trailing edge of the printing plate is then attached to a clamping bar arranged in a groove provided in the cylinder. In this device, the clamping bar comprises a plurality of sections arranged axially relative to the plate cylinder. Each section of the clamping bar is provided with a spring element which exerts a corresponding tensile force on the trailing edge of the printing plate. The individual sections of the clamping bar are moveable about two different pivot axes, such movement of the individual clamping bar sections is possible approximately in the circumferential direction of the plate cylinder. The spring elements assigned to the individual clamping bar sections, pivot the individual clamping bar sections from the front wall of the groove in the plate cylinder towards the middle of the groove. In order to introduce the edge of a printing plate into the clamping devices, all the of the clamping bar sections are pivoted counter to the spring force in the direction of the front wall of the groove and the end of the printing plate is inserted into the clamping gap. The clamping device is then actuated. The clamping of the trailing edge of the printing plate in conjunction with the application of a tensile force via the corresponding spring elements results in an automatically increasing clamping force being applied to the printing plate.

The rolling between the blanket cylinder and the back pressure cylinder, however, can result in the stretching of the printing material. In addition, the stretching of the printing material is particularly influenced by the effects of the damping solution. If not corrected for this stretching will adversely effect the print quality, particularly at the trailing edge of the printing image. Accordingly, it is desirable to able to vary the setting or exertion of tensile forces on the printing plate across the format width of the printing machine. For example, it is desirable to allow for correction of a change in the printing length (length of the printing image on the printing material) caused by the effects of the damping solution on the printing material. This is a particular problem at the trailing edge of the printing image.

In the device disclosed in the above mentioned publication DE 4,214,168 C2, these corrections can be accomplished by changing the corresponding pre-tensioning forces for the spring elements acting on the individual clamping-bar sections. Specifically, the individual adjustment of the tensioning forces exerted on the trailing edge of the printing plate must be carried out after mounting and tensioning a printing plate on the plate cylinder and after producing the first few printed copies (a few machine rotations).

A disadvantage of this procedure is that the individual setting of the pre-tensioning forces of the spring elements assigned to the individual clamping-bar sections is a very time consuming operation. Furthermore, once the pre-tensioning of the spring elements are set, they keep that particular setting even after the used printing plate has been removed. Thus, when a new printing plate is mounted, it will be tensioned around the outside circumference of the plate cylinder with a force which varies across the format width of the printing machine. In particular, the tensile force which is applied to the new plate will be based on the settings of the individual spring elements which were used to correct the print quality of the print order which was run with the previous printing plate. It is possible that the settings which were used to correct the print quality of the previous print order may have a negative impact on the print quality of the new print order, particularly with respect to the first few copies. Accordingly, the entire tensioning device has to be returned to a starting position after a used printing plate has been removed. If this resetting or return of the tensioning device to the starting position is forgotten, it is also possible that a new printing plate will be mounted with such widely different tensile forces over the format width that the printing plate may be permanently damaged.

A device for the in-register mounting of printing plates on the plate cylinder of printing machines is known from DE 4,321,751 C. With this device, a hand tool with an eccentric cam surface is provided which interacts with a clamping bar in order to allow for the individual correction of the tensile forces exerted on the trailing edge of the printing plate. Specifically, the eccentric cam surface mounted on the hand tool acts on a portion of the clamping in such a way that the tensile forces exerted on the trailing edge of the printing plate can be increased. The printing plate can therefore be stretched in a defined manner in specific sections with the stretching force being applied solely during the actuation of the hand tool. Once this stretching of the printing plate over the format width of the printing machine has been accomplished, only the spring forces act on the printing plate. With this device, after a used printing plate which has been stretched in individual sections has been removed, a new printing plate can be mounted around the outside circumference of the plate cylinder with a constant tensioning force across the format width of the machine. However, the hand tool can only be used to stretch portions of the printing plate and no allowance is made for reducing the tensile forces which act on the trailing edge of the printing plate.

OBJECTS AND SUMMARY OF THE INVENTION

Accordingly, in view of the foregoing, it is a general object of the present invention to provide an adjusting device for printing plates on the plate cylinder of a printing machine which allows for selective correction of the tensile forces exerted on the trailing edge of the printing plate across the format width of the printing machine.

A further object of the present invention is to provide an adjusting device for printing plates on the plate cylinder of a printing machine which resets automatically so that when a new printing plate is drawn onto the plate cylinder the tensile force exerted on the trailing edge of the printing plate is uniform across the format width of the printing machine.

The present invention provides these and other advantages with a device for adjusting the tension applied on a printing plate on a plate cylinder of a sheet-fed offset printing machine. The adjusting device includes a clamping bar comprising at least one section and having a clamping gap which receives an end of the printing plate. Moreover, the clamping bar is arranged so that it can move approximately in the circumferential direction of the plate cylinder. The adjusting device further includes a spring element which acts on the clamping bar so as to apply a tensile force on the printing plate. The adjusting device also including an adjusting element pivotally supported on the cylinder such that it can be pivoted counter to the force of a spring from a disengaged position into engagement with the clamping bar in order to selectively reduce the tensile forces exerted on the printing plate by the spring element.

The adjusting device of the present invention thus allows the tensile force acting on a printing plate mounted on a plate cylinder to be adjusted across the format width of the printing machine in order to correct for problems such as stretching of the printing material. In addition, the adjusting element automatically returns to the disengaged position when a printing plate is removed thereby ensuring that a new printing plate will be drawn onto the plate cylinder with a uniform tensile force applied across the width of the printing machine.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention as defined by the appended claims.

DETAILED DESCRIPTION OF THE PREFERRED EMBODIMENT

Figure 1:
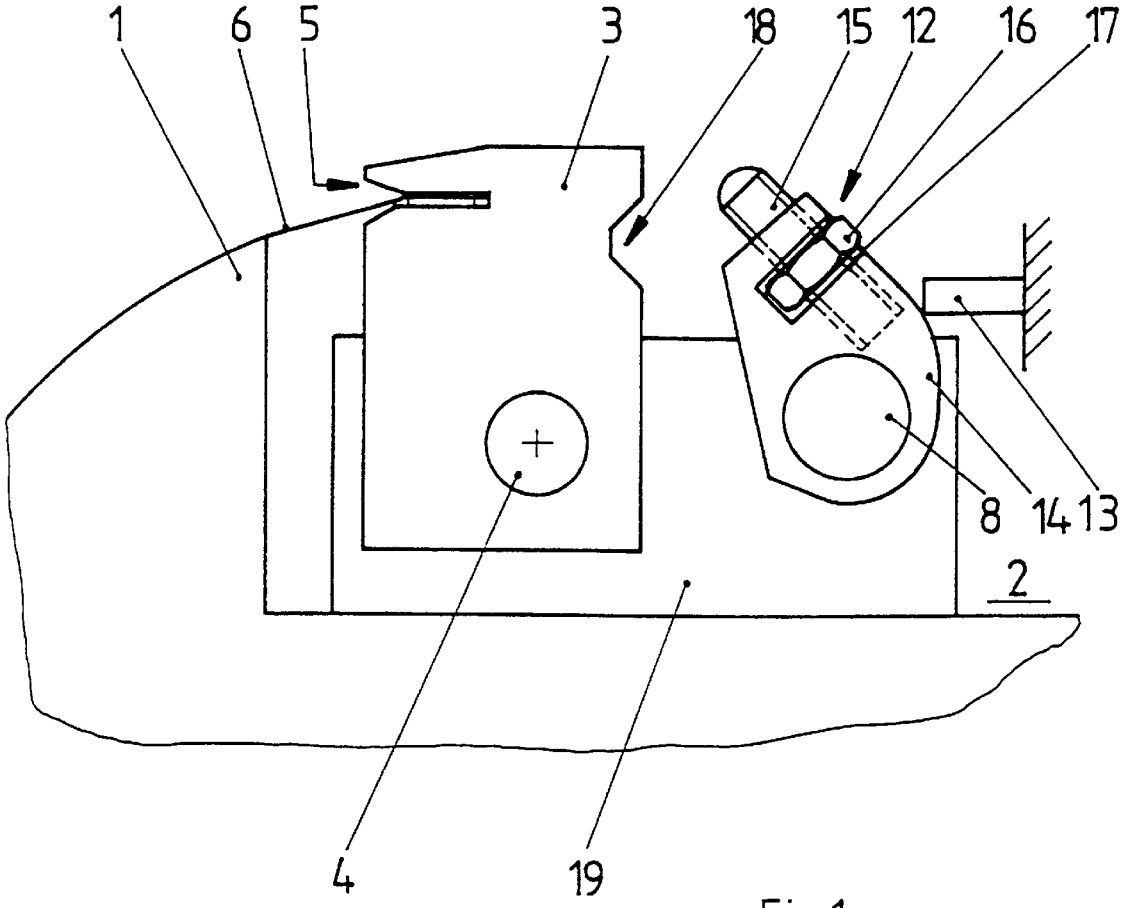
FIG. 1 is a sectional view of one preferred embodiment of the device for adjusting the tension applied on a printing plate mounted on the plate cylinder of a printing machine of the present invention showing the adjusting element in the disengaged position.
Figure 10:
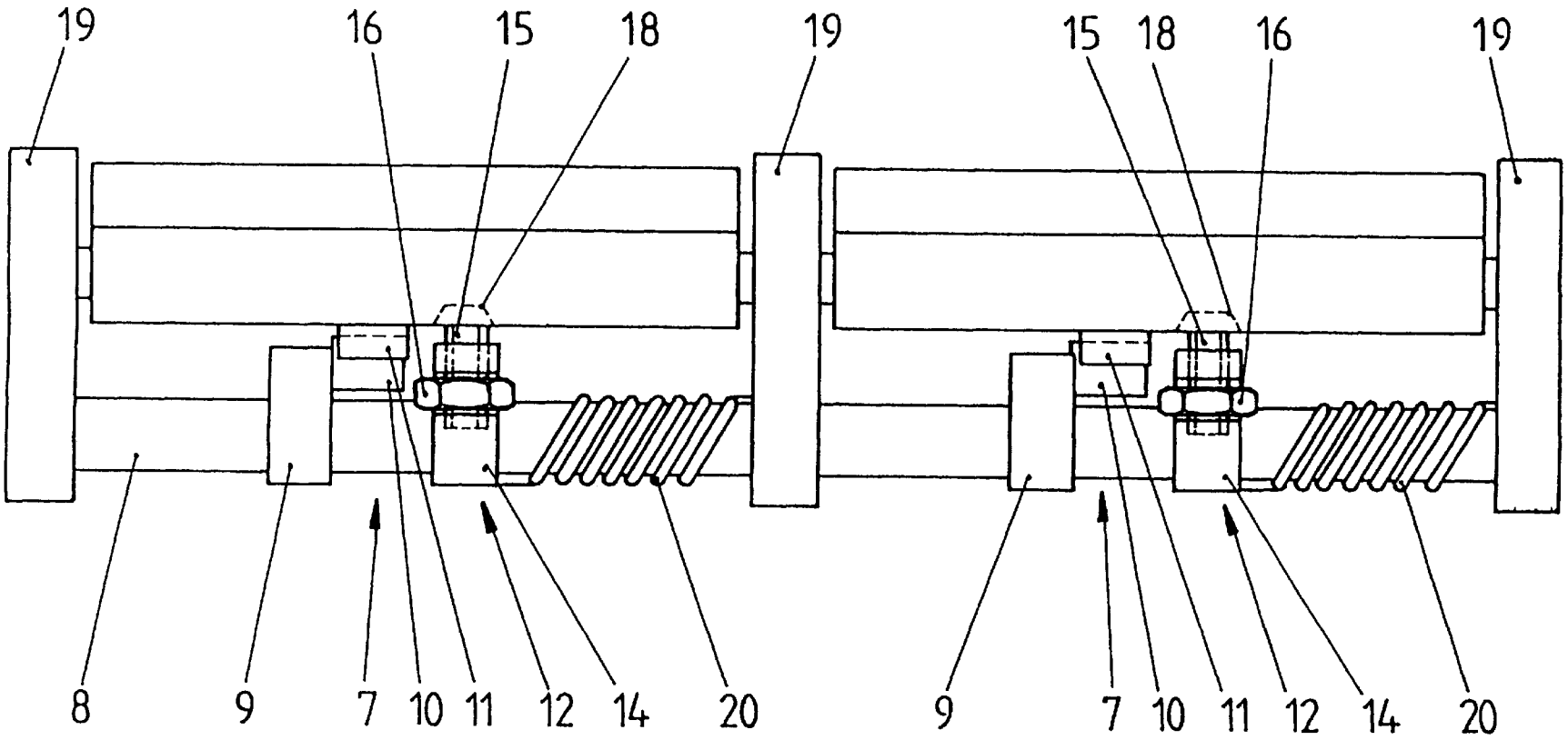
FIG. 10 is a partial plan view showing two clamping bar sections each of which has the adjusting element of FIG. 1 and the actuating device of FIG. 6.

FIG. 1 illustrates a clamping bar 3 which is arranged in an axially parallel groove 2 in a plate cylinder 1 in the area of the plate cylinder corresponding to the trailing edge of print (the print end). The clamping bar 3 is comprised of one or more adjacent clamping bar sections. As shown in FIG. 10, in the illustrated embodiment, the clamping bar 3 comprises a pair of adjacent clamping bar sections. The individual sections of the clamping bar 3 are pivotable about at least one pivot axis 4 so that a clamping gap 5 within the clamping bar 3 can be moved approximately in the circumferential direction of the plate cylinder 1. Specifically, as shown in FIG. 10 the individual sections of the clamping bar 3 are pivotably arranged between carriers 19 mounted spaced apart from one another at the base of the groove 2. Clamping devices (not shown) are arranged in the individual sections of the clamping bar 3 for attaching the trailing edge of the printing plate 6 in the clamping gap 5.

In order to provide a tension force for drawing a printing plate around the circumferential surface of the plate cylinder, at least one spring element (not shown) acts on each section of the clamping bar 3. Specifically, these spring elements pivot the clamping bar about the pivot axis 4 (or successively about a plurality of pivot axes) such that a printing plate 6 attached in the clamping gap 5 is tensioned around the outside contour of the trailing edge region of the plate cylinder 1. As will be appreciated, the use of such spring elements to exert tensile forces on a printing plate via the clamping bar 3 is well known and, as such a detailed description of the spring elements is not necessary.

In order to pivot the clamping bar 3 counter to the spring elements to allow for the release of a used printing plate or the attachment of a new printing plate, an actuating device 7 is provided for each of the individual sections of the clamping bar 3. The actuating device 7 includes a shaft 8 which extends in the groove 2 of the plate cylinder 1 parallel to the clamping bar 3 and the pivot axis 4. The shaft 8 is rotatably mounted at the base of the groove and includes a plurality of levers 9 at least one of which corresponds to each of the individual sections of the clamping bar 3. As best shown FIGS. 6–9, rollers 10 are mounted at the free end of each of the levers 9. The rollers 10 are adapted to engage contours 11 mounted on the portion of the clamping bar 3 opposite from the clamping gap 5 such that rotation of the shaft 8, and in turn the levers 9, causes the clamping bar 3 to pivot. In the illustrated embodiment, the individual carriers 19 which support the sections of the clamping bar 3 also serve to bear the shaft 8 as shown in FIG. 10.

Figure 7:
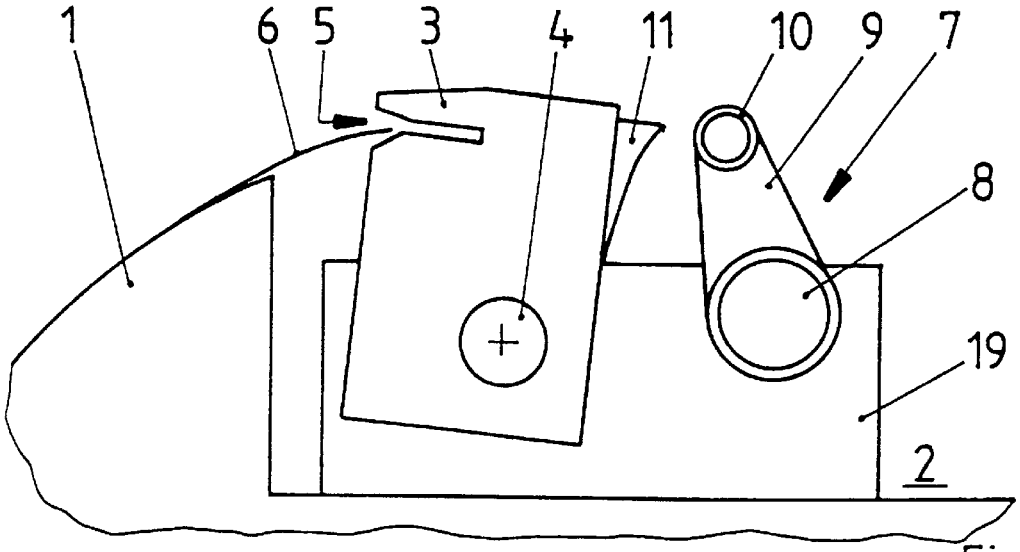
FIG. 7 is a sectional view of the clamping bar actuating device of FIG. 6 showing the actuating device in the disengaged position and the leading edge of a printing plate positioned for introduction into the clamping bar.

In order to begin the process of introducing a new printing plate 6 into the clamping bar 3, the shaft 8 is rotated such that the rollers 10 move out of engagement with the contours 11 on the clamping bar as shown in FIG. 7. Once the rollers 10 are out of engagement with the contours 11, the individual sections of the clamping bar 3 are pivoted back to an initial position by the force of the spring elements. The initial position of the clamping bar 3 is defined by the force exerted by the spring elements, however, stops (not shown) may be provided in order to more clearly define this initial position of the clamping bar.

Figure 8:
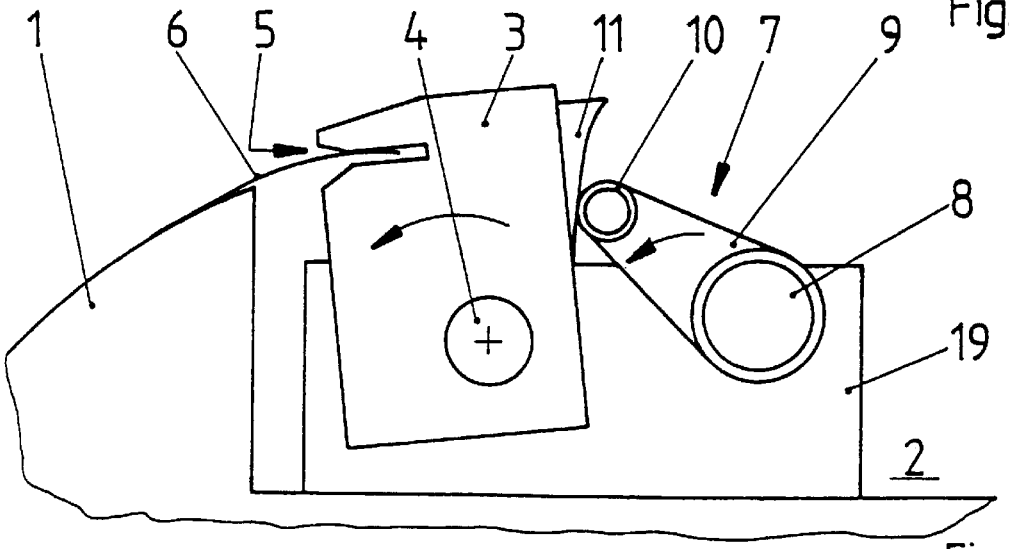
FIG. 8 is a sectional view of the clamping bar actuating device of FIG. 6 showing the actuating device pivoting the clamping bar so as to introduce the trailing edge of the printing plate into the clamping bar.

Once the trailing edge of the printing plate 6 has been brought into position, the clamping bar 3 is then pivoted about the pivot axis 4 by means of the actuating devices 7 which correspond to the individual sections of the clamping bar 3. In particular, this pivoting of the clamping bar 3 is accomplished by pivoting the shaft 8, and in turn the levers 9 and the rollers 10, in a counter-clockwise direction (as defined by reference to FIGS. 7–9). As illustrated in FIGS. 7–8, this counter-clockwise rotation of the shaft 8 causes the rollers 10 on the individual levers 9 to cam over the contours 11 so as to pivot the clamping bar towards the print end portion of the cylinder. This pivoting of the clamping bar 3 enables the trailing edge of the printing plate 6 to be introduced into the opened clamping gap 5 (FIG. 8).

Figure 9:
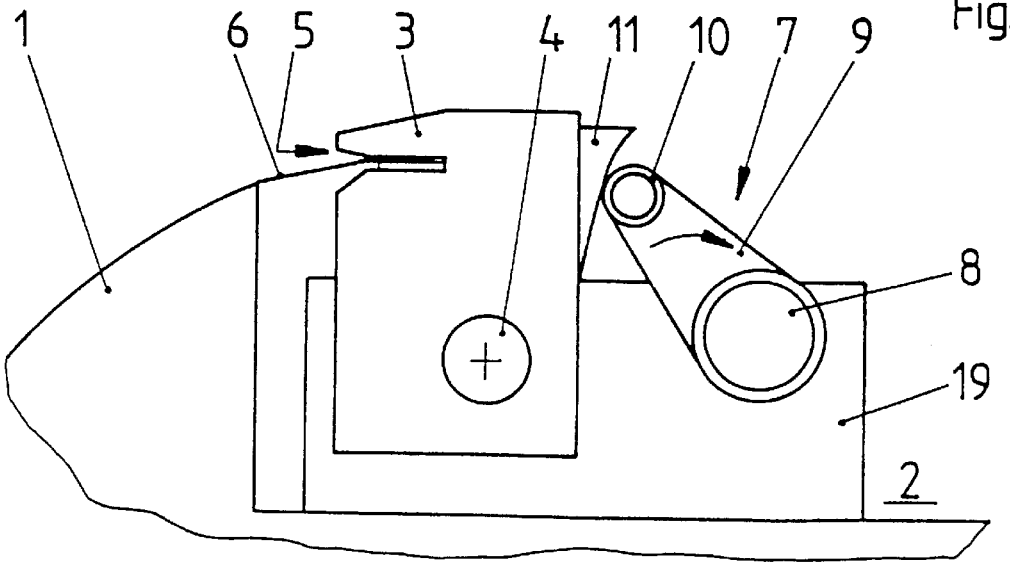
FIG. 9 is a sectional view of the clamping bar actuating device of FIG. 6 showing the printing plate being tensioned by the clamping bar.

Next, the clamping device (not shown) is actuated in order to attach the trailing end of the printing plate 6 in the clamping gap 5. The tension of the shaft 8 is then relieved, so that the individual sections of the clamping bar 3 are pivoted back by the force of the spring elements (not shown) thereby acting to tension the printing plate 6 as shown in FIG. 9.

In accordance with one important aspect of the present invention, one or more adjusting elements 12 are provided which enable the tension force acting on the printing plate as a result of the spring elements to be selectively adjusted. Specifically, at least one adjusting element 12 is provided for each of the individual sections of the clamping bar 3. Each adjusting element 12 is mounted to the plate cylinder 1 so as to be pivotable about an axis parallel to the axis of the plate cylinder. In the illustrated embodiment, each adjusting element 12 is mounted so as to be pivotable about the shaft 8 of the actuating device 7 and is positioned adjacent a respective one of the levers 9, as shown in FIG. 10. The adjusting element 12 is normally pivoted into a disengaged position, such as shown in FIG. 1, by the force of a pre-tensioned swivel pin spring 20 which is arranged around the shaft 8 of the actuating device 7. As shown in FIG. 10, the swivel pin spring 20 for each adjusting element 12 is wrapped around the shaft 8, with one end of the swivel pin spring 20 being supported on a carrier 19 and with the other end acting on a link 14 of the adjusting element 12. An appropriate stop may be provided on the cylinder 1 in order to limit the pivotal movement of the adjusting element 12 which is caused by the swivel pin spring 20 and to help define the disengaged position.

To allow for pivotal movement of the adjusting element 12 relative to the shaft 8, each adjusting element includes a link part 14 which surrounds the shaft 8 in the manner of a bushing. A threaded bolt 15 is seated in a corresponding bore in the link 14 such that it can move longitudinally relative to the link 14. As shown in FIG. 1, one end of the threaded bolt 15 has a ball-like configuration and projects from the link part 14 such that it points towards the clamping bar 3. A nut 16, having for example a hexagonal or knurled configuration, is provided on the threaded bolt 15 and is arranged in a slot 17 formed in the link part 14. In order to allow for the nut 16 to be turned with a fork wrench or the like, the outside diameter of the nut 16 is larger than the width of the link part 14. The nut 16 is prevented from moving axially by the flanks of the slot 17 such that the length of the portion of the threaded bolt 15 which projects from the link part can be adjusted by turning the nut 16.

Figure 2:
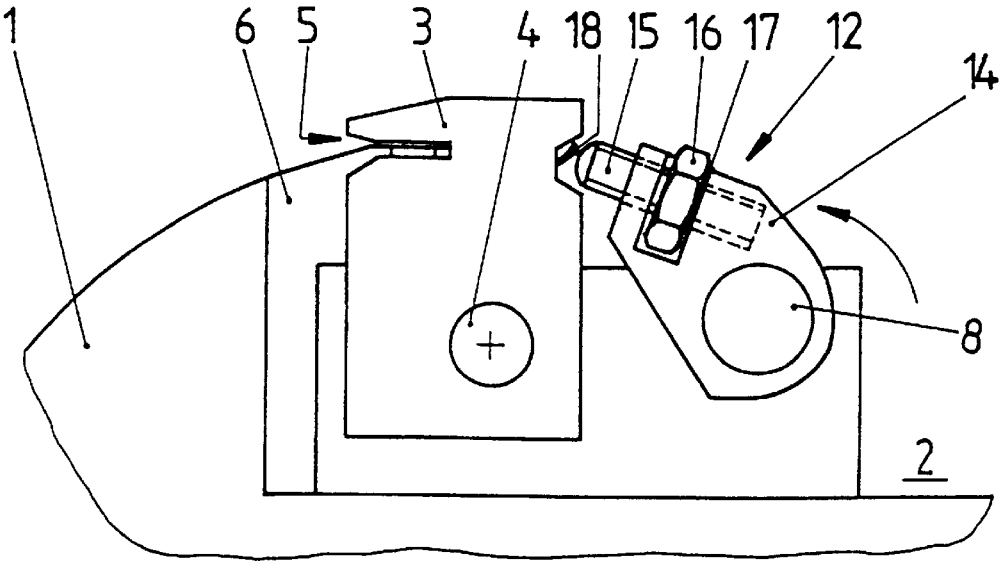
FIG. 2 is a sectional view of the printing plate adjusting device of FIG. 1 showing the adjusting element rotating towards the engaged position.
Figure 3:
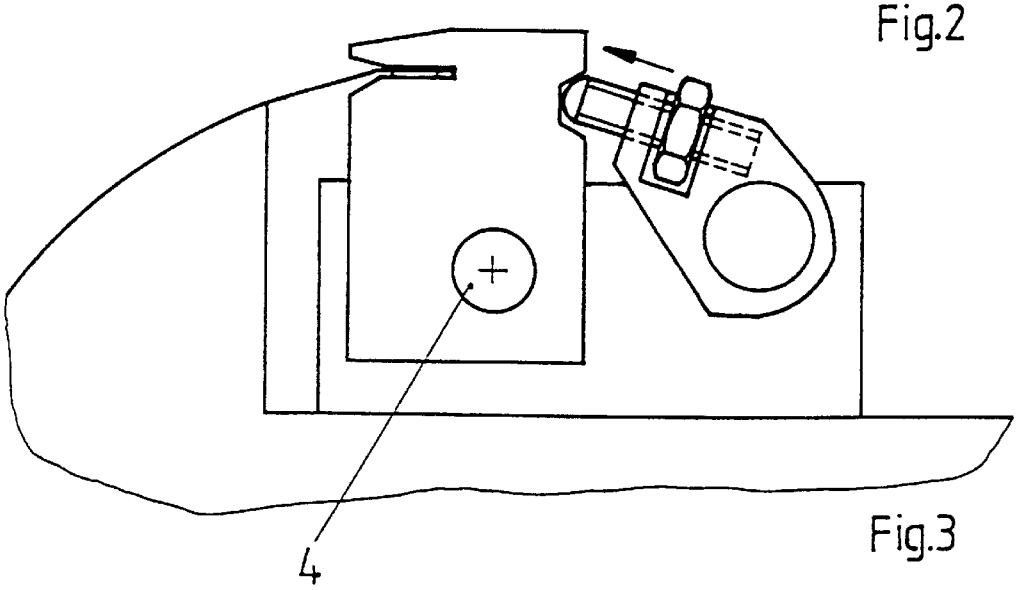
FIG. 3 is a sectional view of the printing plate adjusting device of FIG. 1 showing the adjusting element in the engaged position.
Figure 4:
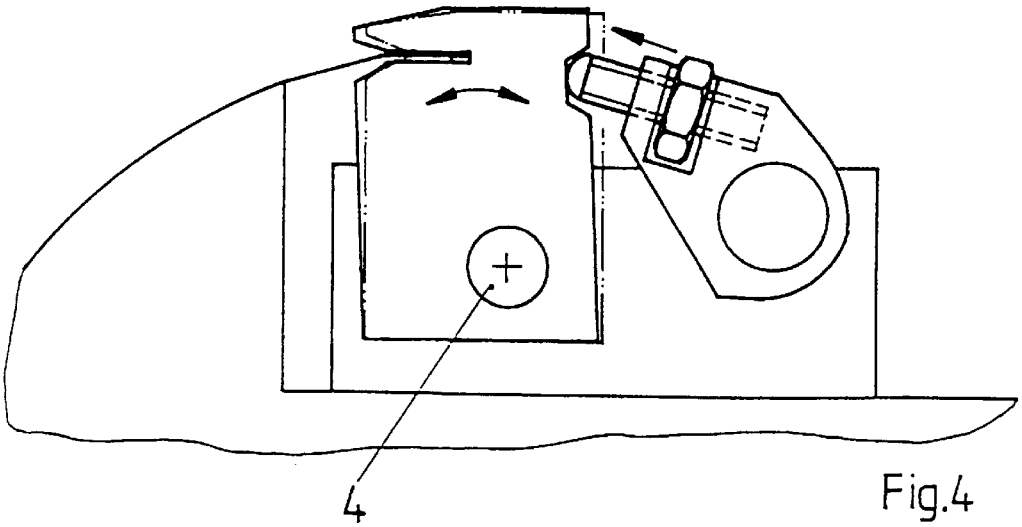
FIG. 4 is a sectional view of the printing plate adjusting device of FIG. 1 showing how the adjusting element can be used to selectively adjust the tension on a printing plate.

FIGS. 2 through 4 illustrate how the adjusting device of the present invention may be used to selectively adjust the tensile forces exerted on the printing plate 6 when the printing plate is mounted on the plate cylinder 1. First, as shown in FIG. 2, the adjusting element 12 is pivoted counter to the swivel pin spring 20 (FIG. 10) out of the disengaged position illustrated in FIG. 1 into engagement with the clamping bar 3. More specifically, the adjusting element 12 is pivoted such that end of the treaded bolt 15 is pivoted towards a recess 18 which is provided on the side of the clamping bar 3 opposite the clamping gap 5. Once the adjusting element 12 has been pivoted into a position such as shown in FIG. 2, wherein the end of the threaded bolt 15 is opposite or within the recess 18, the nut 16 is turned, for example by hand, until the ball-like end of the threaded bolt 15 engages the recess 18 in the clamping bar 3. At his point, the tensile force exerted on the printing plate may be reduced simply by turning the nut 16 further. This further turning of the nut 16 will further increase the length of the portion of the threaded bolt 15 which projects from the link 15 and cause the threaded bolt 15 to exert a force on the clamping bar 3. This force will pivot the clamping bar 3 towards the print end portion of the plate cylinder thereby reducing the tensile force exerted on the printing plate 6 by the spring element. FIG. 4 illustrates how the tensile force on the printing plate 6 can be reduced by using the adjusting element 12 to pivot the clamping bar 3 from a first position shown in dashed lines to a second position shown in solid lines. As will be appreciated, the tensile force on the printing plate 6 can be varied across the format width of the printing machine by individually adjusting the threaded bolts 15 of the adjusting elements 12 which correspond to each of the individual sections of the clamping bar 3.

Figure 5:
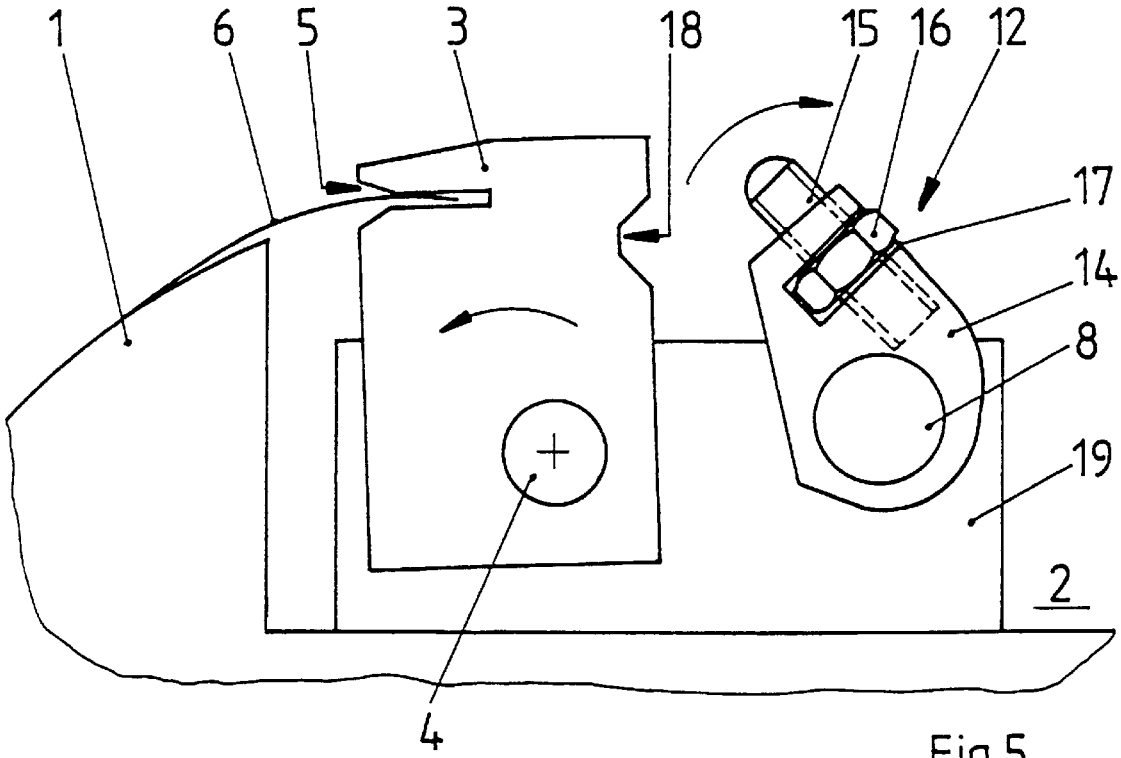
FIG. 5 is a sectional view of the printing plate adjusting device of FIG. 1 showing the adjusting element rotating back into the disengaged position.
Figure 6:
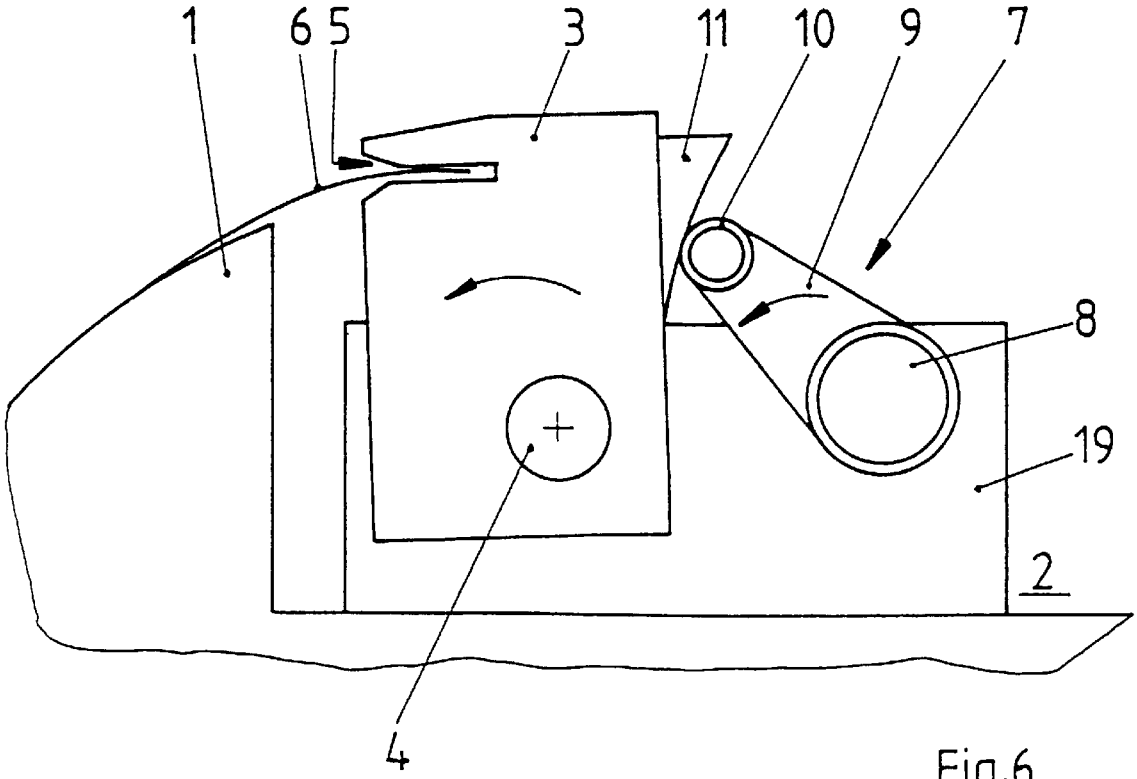
FIG. 6 is a sectional view of one preferred embodiment of an actuating device for a clamping bar which can be used in conjunction with the printing plate adjusting device of the present invention.

In order to change a used printing plate 6, the individual sections of the clamping bar 3 are pivoted by the actuating device 7 out of the position illustrated in FIGS. 3, 4 and 9 towards the print end portion of the plate cylinder 1. Particularly, as described in connection with the attachment of a new printing plate 6, the pivotal movement of the clamping bar 3 counter to the force of the spring elements is brought about by pivoting the shaft 8 such that the rollers 10 cam over the contours 11 of the clamping bar 3 thereby driving the pivotal movement of the clamping bar 3. As the individual sections of the clamping bar 3 pivot towards the print end of the plate cylinder 1, the ends of the threaded bolts 15 of the adjusting elements 12 which had previously been used to selectively correct the tensile force acting on the printing plate 6 are released from the recesses 18 in the respective sections of the clamping bar 3. Once the ends of the threaded bolts 15 are released from the corresponding recesses 18, the adjusting elements 12 will pivot back into the disengaged position (see, e.g. FIG. 1) due to the force of the swivel pin springs 20 assigned to the individual adjusting elements 12 as best shown in FIGS. 5 and 6. Thus, the adjusting elements 12 automatically reset when a printing plate 6 is removed from the plate cylinder 1 so that when a new printing plate is attached for the following print order it is mounted with a uniform tensile force applied across the format width of the printing machine.

In order to reset an adjusting element 12 for the next printing operation after it has pivoted back into the disengaged position (FIG. 5), the threaded bolt 15 should be actuated via the nut 16 so as to adjust the length of the threaded bolt extending from the link 14 back to its length prior to it being brought into engagement with the clamping bar 3. Furthermore, the maximum length by which the threaded bolt 15 can extend from the link 14 is selected to be such that when the adjusting element 12 is in the disengaged position the end of the threaded bolt 15 does not protrude past the circumferential surface of the plate cylinder 1. This ensures that the adjusting element 12 will not interfere with the corresponding components of the blanket cylinder which are interacting with the plate cylinder 1 or with the rollers of the inking or damping unit.

If the adjusting element 12 is to be used to provide a correction of the tensile force acting on the printing plate 6 during a later printing operation, the length of portion of the threaded bolt 15 extending from the link 14 via the nut 16 should first be adjusted to a specific preselected length as necessary. Once a new printing plate has been attached to the plate cylinder, the adjusting element 12 is merely pivoted back into engagement with the recess 18 of the respective section of the clamping bar 3.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A device for adjusting the tension applied on a printing plate mounted on a plate cylinder of a sheet-fed offset printing machine, the adjusting device comprising, in combination:

a clamping bar comprising at least one clamping bar section, the clamping bar having a clamping gap which receives an end of the printing plate and being arranged so that it can move approximately in the circumferential direction of the plate cylinder so as to receive an end of the printing plate in the clamping bar, a first spring element which acts on the clamping bar so as to apply a tensile force on the printing plate, and an adjusting element pivotally supported on the cylinder, a second spring element biasing the adjusting element to a position in disengaged relation to the clamping bar, and said adjusting element being movable against the biasing force of said spring into engaging relation with the clamping bar to selectively reduce the tensile forces exerted on the printing plate by the first spring element.

2. The adjusting device as in claim 1 wherein the clamping bar includes a plurality of sections and a corresponding adjusting element is provided for each section of the clamping bar.

3. The adjusting device as in claim 1 wherein the adjusting element is supported on the plate cylinder such that it is pivotable about an axis which runs parallel to the axis of the plate cylinder.

4. The adjusting device as in claim 1 including an actuating device mounted on a shaft for moving the clamping bar approximately in the circumferential direction of the plate cylinder, and said adjusting element being pivotably supported on said shaft.

5. The adjusting device as in claim 1 wherein the adjusting element comprises a link which is pivotally supported on the plate cylinder, said link having a base and a bolt, a bolt having a threaded shank disposed in a corresponding bore in the link such that the bolt is axially adjustable relative to the link, the bolt having an end which extends from the link to engage the clamping bar when the adjusting element is pivoted into contact with the clamping bar, and a nut arranged on the bolt and secured against axial movement for adjusting the bolt relative to the link.

6. The adjusting device as in claim 5 wherein the clamping bar includes a recess which engages the end of the bolt when the adjusting element is pivoted into engagement with the clamping bar.

* * * * *